US007198503B1

(12) United States Patent
Chen et al.

(10) Patent No.: US 7,198,503 B1
(45) Date of Patent: Apr. 3, 2007

(54) SECURING DEVICE FOR PCB WITH I/O PORTS

(75) Inventors: Yun-Lung Chen, Shenzhen (CN); Quan-Guang Du, Shenzhen (CN)

(73) Assignees: Hong Fu Jin Precision Industry (Shenzhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/306,465

(22) Filed: Dec. 29, 2005

(51) Int. Cl.
*H01R 13/64* (2006.01)

(52) U.S. Cl. ..... 439/378

(58) Field of Classification Search ..... 439/378, 439/362, 564; 361/728–747, 752–759, 796–802, 361/805–837
See application file for complete search history.

(56) References Cited

U.S. PATENT DOCUMENTS

| | | | | |
|---|---|---|---|---|
| 5,834,693 | A | 11/1998 | Waddell et al. | |
| 6,231,385 | B1 * | 5/2001 | Kuo | 439/557 |
| 6,339,536 | B1 | 1/2002 | Buican et al. | |
| 6,422,892 | B1 * | 7/2002 | Chen et al. | 439/378 |
| 6,663,394 | B1 * | 12/2003 | Chung | 439/564 |
| 6,752,638 | B2 * | 6/2004 | Na | 439/76.1 |

* cited by examiner

*Primary Examiner*—Tulsidas C. Patel
*Assistant Examiner*—Phuongchi Nguyen
(74) *Attorney, Agent, or Firm*—Wei-Te Chung

(57) ABSTRACT

A securing device assembly in a computer enclosure includes a panel (10) and a printed circuit board (20). The panel defines an opening (11). The printed circuit board includes a base board (21), and at least one electrical component (27/28) mounted on the base board. The base board being directly attached to the panel with the at least one electrical component being accessible through the opening.

7 Claims, 3 Drawing Sheets

SECURING DEVICE FOR PCB WITH I/O PORTS

DESCRIPTION

1. Field of the Invention

The present invention relates to securing devices, and more particularly to a securing device for conveniently securing a PCB (Printed Circuit Board) with I/O (input/output) ports to a computer enclosure.

2. Description of Related Art

A conventional computer system usually includes I/O ports, for connecting with microphones, earphones, or USB (Universal Serial Bus) devices, thereby enhancing the additional functions of the computer system.

The computer usually includes a chassis, a back panel, a front panel, and a front bezel. The I/O ports are mounted on a PCB. The PCB is usually attached to the back panel or the front panel with a removable bracket. A plurality of securing holes is defined in the bracket. A plurality of fasteners is provided to secure the bracket to the front panel.

However, it is inconvenient to secure the PCB to the front panel of the computer using the bracket. Moreover, manufacturing the bracket will cost the production resource.

What is needed, therefore, is a securing device, which has a simple structure and allows convenient securing of a PCB with I/O ports to a computer enclosure.

SUMMARY OF INVENTION

A securing device assembly in a computer enclosure includes a panel and a printed circuit board. The panel defines an opening. The printed circuit board includes a base board, and at least one electrical component mounted on the base board. The base board being directly attached to the panel with the electrical component being accessible through the opening.

Other advantages and novel features will be drawn from the following detailed description of a preferred embodiment with attached drawings, in which:

DETAILED DESCRIPTION

Figure 1:
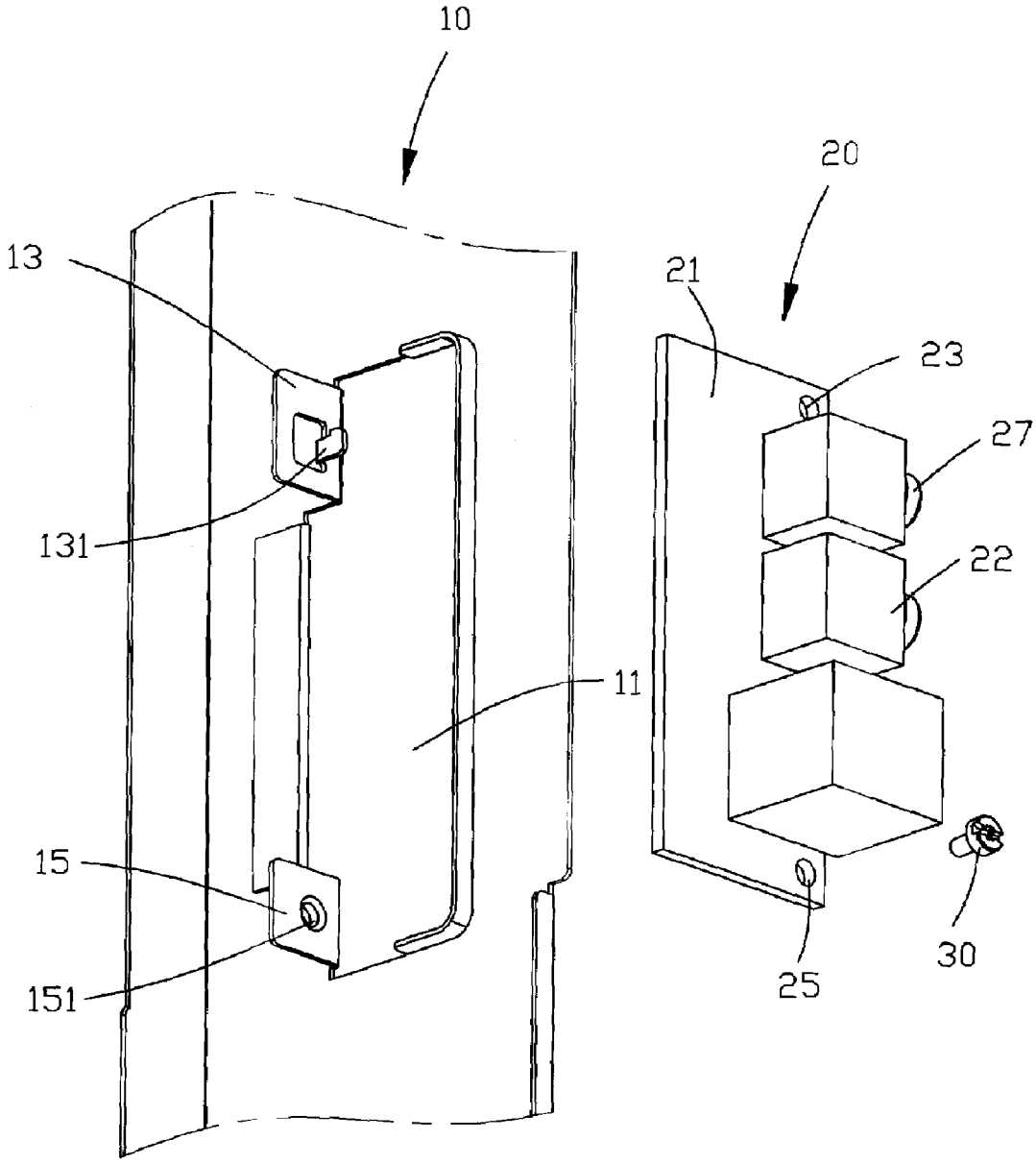
FIG. 1 is an exploded, isometric view of a securing device of a preferred embodiment of the present invention, the securing device including a panel and a PCB with I/O ports.

Referring to FIG. 1, a securing device in accordance with a preferred embodiment includes a panel 10 and a PCB 20. The panel 10 can be a front panel, a side panel, a back panel, or a top panel of a computer enclosure for I/O communication.

The panel 10 defines a generally rectangular opening 11 for receiving the PCB 20. A first bending tab 13 and a second bending tab 15 are respectively bent inwardly and perpendicularly from an edge of the opening 11 of the panel 10. A hook 131 is bent outward from the first bending tab 13 by stamping. The second bending tab 15 defines a locking hole 151.

The PCB includes a base board 21, and a plurality of connecting components 22 perpendicularly disposed on the base board 21. A securing hole 23 is defined in top portion of the base board 21 corresponding to the hook 131 of the panel 10. A locking hole 25 is defined in the bottom portion of the base board 21 corresponding to the locking hole 151 of the panel 10. A plurality of I/O ports 27, 28 (see FIG. 3) is defined in one side of the connecting components 22.

Figure 2:
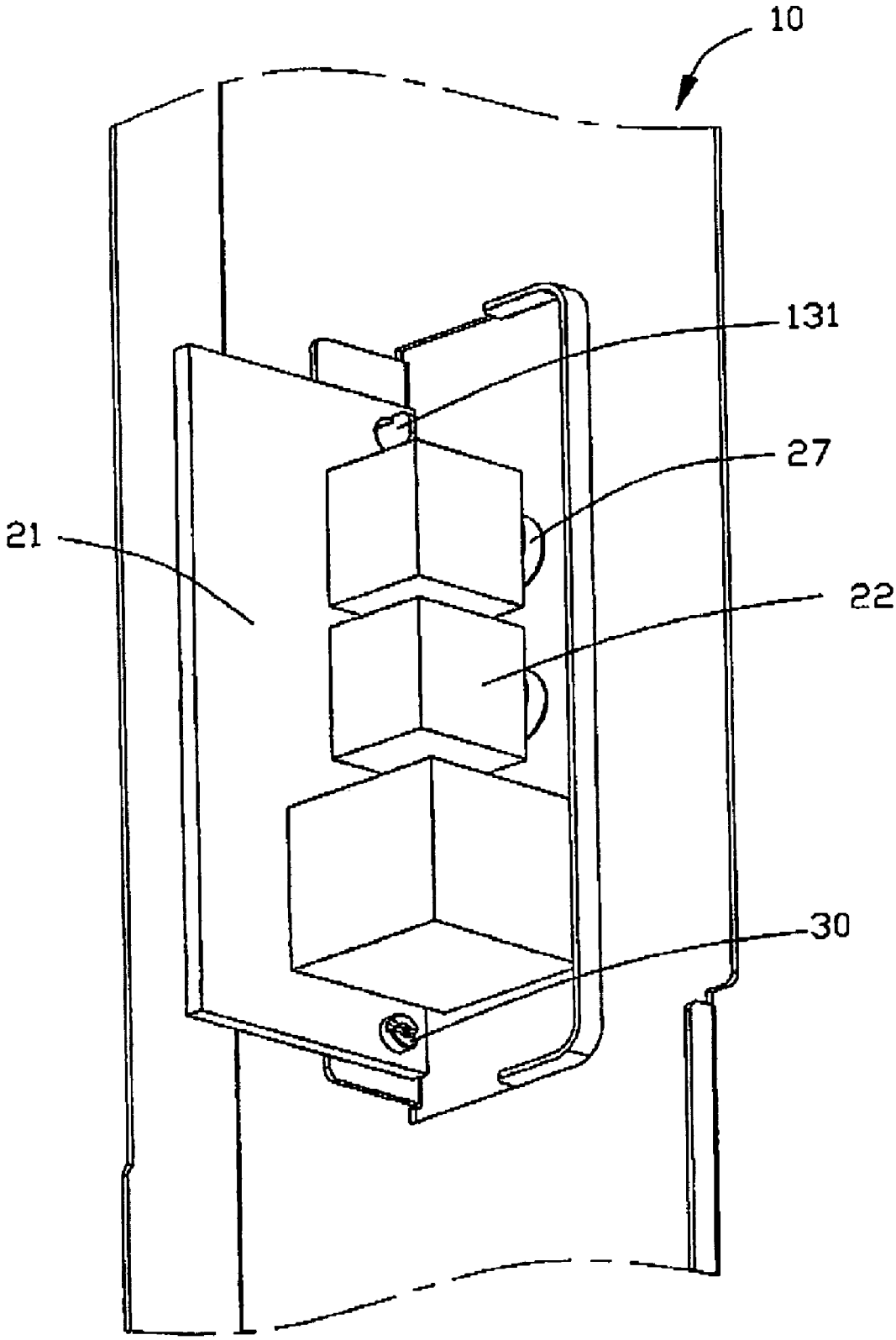
FIG. 2 is an assembled, view of the securing device of FIG. 1.
Figure 3:
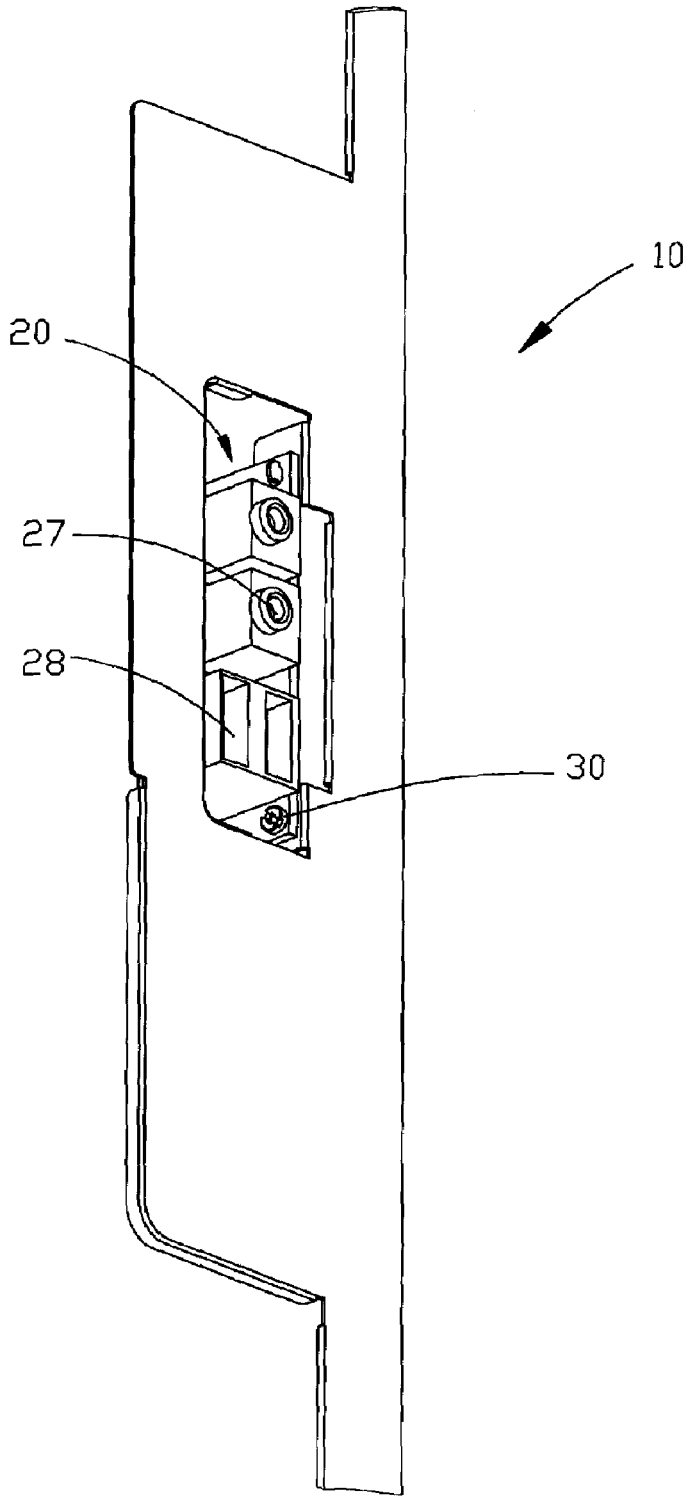
FIG. 3 is similar to FIG. 2, but viewed from another aspect.

Referring to FIGS. 2 and 3, in assembly, the hook 131 of the panel 10 is engaged into the securing hole 23 of the PCB 20. A fastener 30 is provided to lock the bottom portion of the PCB 20 through the locking hole 25 of the PCB 20 into the locking hole 151 of the panel 10. Thus, the PCB 20 is secured to the panel 10, with the base board 21 being perpendicular to the panel 10. The I/O ports 27, 28 are exposed through the opening 11 of the panel 10 and therefore accessible through the opening 11 from an exterior of the computer enclosure.

Typically the PCB 20 has printed circuits that are connected to a motherboard in the computer enclosure. The I/O ports 27,28 are usually used to receive microphones, earphones, or USB devices, such as digital cameras and MP3 players.

In other embodiments the securing method of the PCB 20 to the panel 10 may include a plurality of fasteners and/or hooks without departing from the spirit and scope of the present invention.

It is to be understood, however, that even though numerous characteristics and advantages have been set forth in the foregoing description of a preferred embodiments, together with details of the structure and function of the preferred embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A securing device assembly, comprising:

a panel defining an opening therein and comprising a first tab and a second tab bent inwardly from an edge of the opening, the first tab having a hook extending upwardly therefrom, the second tab defining a locking hole therein; and a printed circuit board comprising a base board, the base board defining a securing hole corresponding to the hook and another locking hole corresponding to the locking hole of the second tab, the securing hole and the locking hole disposed at opposite sides of the printed circuit board, and at least one electrical component positioned on the base board adjacent the opening, and the electrical component being accessible through the opening, wherein the printed circuit board is installed into the opening of the panel with the hook snapping into the securing hole for positioning the printed circuit board initially, and the another locking hole of the printed circuit board aligning with the locking hole of the second tab for a fastener extending therethrough to secure the printed circuit board.

2. The securing device assembly as described in claim 1, wherein the at least one electrical component comprises an I/O port.

3. The securing device assembly as described in claim 1, wherein the panel is one of a front panel, a back panel, a side panel, a top panel of a computer enclosure.

4. A securing device assembly, comprising:

a panel defining an opening therein, at least one bending tab bent from an edge of the opening perpendicular to the panel, a hook extending upward from the at least one tab; and a printed circuit board comprising a base board and at least one electrical component mounted on the base board, the base board defining a securing hole corresponding to the hook, the base board being directly attached to the panel with the at least one electrical component being accessible through the opening, wherein when installing the printed circuit board to the panel, the hook engages the securing hole for facilitating securing thereafter.

5. The securing device assembly as described in claim 4, wherein the electrical component is an I/O port.

6. The securing device assembly as described in claim 4, wherein the at least one bending tab comprises a first bending tab and a second bending tab.

7. The securing device assembly as described in claim 6, wherein the hook is formed on the first bending tab, the second bending tab and the base board respectively define a locking hole therein, and a fastener is provided for securing the locking holes.

* * * * *